US008628210B2

(12) United States Patent
Tucker et al.

(10) Patent No.: US 8,628,210 B2
(45) **Date of Patent: *Jan. 14, 2014**

(54) PORTABLE LIGHT

(71) Applicants: Mark H. Tucker, Deposit, NY (US); Yalin Liu, Shanghai (CN)

(72) Inventors: Mark H. Tucker, Deposit, NY (US); Yalin Liu, Shanghai (CN)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 7 days.

This patent is subject to a terminal disclaimer.

(21) Appl. No.: 13/815,253

(22) Filed: Feb. 14, 2013

(65) Prior Publication Data

US 2013/0155665 A1 Jun. 20, 2013

Related U.S. Application Data

(63) Continuation of application No. 13/064,579, filed on Apr. 1, 2011, now Pat. No. 8,414,142.

(30) Foreign Application Priority Data

May 21, 2010 (CN) ..... 2010 2 0203517 U

(51) Int. Cl.
*F21L 4/02* (2006.01)
*F21V 15/00* (2006.01)

(52) U.S. Cl.
USPC ..... 362/184; 362/205; 362/191; 362/118

(58) Field of Classification Search
USPC ..... 362/158, 191, 197, 185, 200, 205, 118
See application file for complete search history.

(56) References Cited

U.S. PATENT DOCUMENTS

| | | | | |
|---|---|---|---|---|
| 6,366,028 | B1 * | 4/2002 | Wener et al. | 315/241 P |
| 6,979,098 | B2 * | 12/2005 | Petzl et al. | 362/177 |
| 7,108,403 | B1 * | 9/2006 | Walters et al. | 362/368 |
| 7,241,024 | B2 * | 7/2007 | Kindberg | 362/186 |
| 8,152,329 | B2 * | 4/2012 | Liao | 362/199 |
| 2008/0174991 | A1 * | 7/2008 | Tucker | 362/200 |

* cited by examiner

*Primary Examiner* — Peggy A. Neils
(74) *Attorney, Agent, or Firm* — Breiner & Breiner, L.L.C.

(57) ABSTRACT

A portable light is disclosed including a housing having an upper end, a lower end and a cavity for receiving a power source therein. The housing further includes at the upper end a channel having channel walls and a plurality of LED lights in the channel. The channel walls have a height greater than the height of the LED lights.

20 Claims, 1 Drawing Sheet

PORTABLE LIGHT

RELATED APPLICATIONS

This is a continuation application of application Ser. No. 13/064,579, filed Apr. 1, 2011, for "Portable Light," which is incorporated herein by reference.

This application hereby claims the benefit under 35 U.S.C. §119 of The People's Republic of China Application No. 201020203517.8, filed May 21, 2010, now issued as The People's Republic of China Patent No. CN 201680159 U on Dec. 22, 2010, entitled "PENLIGHT," which application is incorporated herein by reference in its entirety.

FIELD OF INVENTION

The present invention relates to a portable light made in the shape of a pen which is easy to carry and use. More particularly, the light of the invention includes a plurality of LED lights in a channel to protect the LED lights from damage.

BACKGROUND OF INVENTION

The prior art is replete with lights having different shapes and functions. However, these lights have various shortcomings, including not being easily carried, not providing a large amount of light, and not being economically useful. Therefore, there is a need for a portable light shaped like a pen and providing the benefits of the present invention as disclosed hereafter.

SUMMARY OF INVENTION

A primary object of the present invention is to provide a superior light source having a shape similar to a pen and which is easy to carry and use.

The portable light of the present invention comprises a housing and plurality light bulbs connected to an electric source, preferably LED lights. A fixing plate is provided inside of the housing. An electric source is provided inside the housing. The light bulbs are provided in a row or column on the fixing plate and extend outwardly from one side face of the housing. A channel is provided on a side face of the housing from which the light bulbs extend and the channel includes outer channel walls having a height greater than the outer end of the light bulbs. An end cap is provided at a lower end of the housing and a spring is provided inside the end cap. The advantage of the outer channel walls of the channel being greater in height than the exterior end of light bulbs is to protect the light bulbs and prevent them from being damaged if the light falls to the ground or unexpectedly collides with another object.

The portable light of the invention further includes a switch cavity at an upper end of the housing. An elastic switch is disposed in the switch cavity at an upper end of the housing and the elastic switch is capped in the switch cavity with a soft button capping. The elastic switch has an open-close two-stage mode, i.e., the light is turned ON by depressing the switch, and the light is turned OFF by depressing the switch again.

The lower end of the housing includes T-shaped spiral grooves or other known threads which mate with the end cap. The end cap closes the lower end of the housing and includes on the inside thereof T-shaped tongues or other known threads corresponding to the T-shaped spiral grooves of the housing. The end cap and the T-shaped tongues are rotated into the T-shaped spiral grooves to secure the end cap to the housing.

A conductive ring is provided inside the lower end of the housing. The conductive ring is connected to a cathode of an electric source, for example, one or more batteries. The conductive ring provides an advantage in that a contact point inside the end cap can be fully connected to the electric source.

Additionally, the portable light invention includes a clamping piece on a side face of the housing. The clamping piece may be connected to the housing by two leg members.

The portable light further includes a soft button capping made of a silicone material or other known materials having similar properties.

The portable light preferably uses white light LED lights, although other colored lights may be used without departing from the scope of the invention.

In a preferred embodiment, the housing face having the channel is substantially flat and the adjacent sidewall of the housing is substantially semicircular.

The portable light of the present invention includes at least the following advantages: (1) the light bulbs are placed in the channel which may prevent them from being damaged; (2) the housing is in the shape of a pen, and thus, is easy to carry; (3) the light includes a switch which is a depression/self-lock two-stage design, i.e., open-close; and (4) the light housing side wall is semicircular and is easily grasped for use.

These aspects and other objects of the present invention will be apparent from the following description of the preferred embodiments of the invention and from the accompanying drawings.

BRIEF DESCRIPTION OF THE DRAWINGS

Referring to the drawings.

Figure 1:
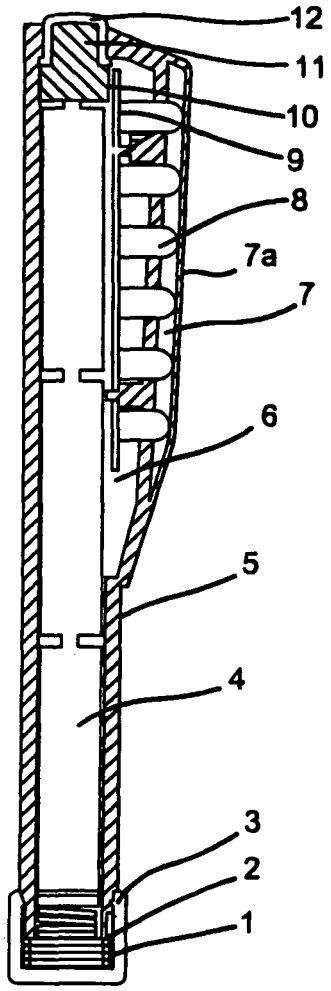
FIG. 1 is a cross-sectional side view of the portable light of the present invention.

In the drawings and description of the invention referred to hereafter, the following reference numerals generally represent the following components:

| | |
|---|---|
| 1 spring | 2 conductive ring |
| 3 end cap | 4 electric source |
| 5 housing | 6 conductive piece for cathode |
| 7 channel | 8 light bulbs |
| 9 fixing plate | 10 lead wire for anode |
| 11 elastic switch | 12 soft button for elastic switch |
| 13 clamping piece | |

DETAILED DESCRIPTION OF THE PREFERRED EMBODIMENTS

Figure 2:
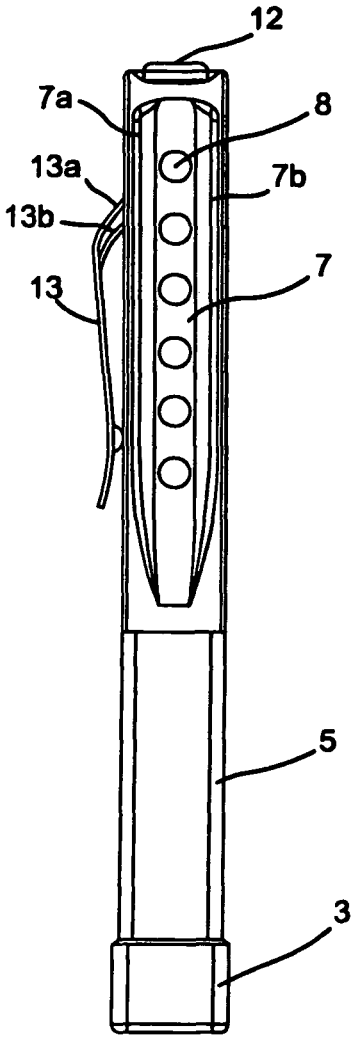
FIG. 2 is a front view of the portable light of the present invention.

As shown in FIGS. 1 and 2, the portable light comprises housing 5 and a plurality of light bulbs 8 connected to an electric source 4 inside the housing, preferably one or more batteries. A fixing plate 9 is provided inside housing 5. Electric source 4 is provided to the inside of housing 5 through an opening therein. Light bulbs 8 are provided in a column on the fixing plate 9 and extend to the outside of the housing from one side face of housing 5. A channel 7 is provided on a side face of housing 5 where the light bulbs extend and includes channel walls 7*a* and 7*b* having a height greater than the outer ends of the light bulbs 8. An end cap 3 is provided at the lower end of housing 5 and having spring 1 inside end cap 3.

The channel walls 7*a* and 7*b* of channel 7 have a height greater than the outer ends of the light bulbs 8 and thereby provides an advantage over known lights in that the channel walls prevent the light bulbs from being damaged if the light falls to the ground or unexpectedly collides with another object because only the outer channel walls 7*a* and 7*b* of channel 7 will be impacted. As shown in the drawings, the channel walls 7*a* and 7*b* may be tapered at the ends thereof.

A switch cavity is provided at an upper end of housing. An elastic switch 11 is disposed in the switch cavity and the elastic switch 11 is capped in the switch cavity with a soft button capping 12. Elastic switch 11 has an open-close two-stage mode, i.e., the light bulbs 8 are turned ON by depressing the switch, and the light bulbs 8 are turned OFF by depressing the switch again.

T-shaped spiral grooves or other known thread means are provided on both sides of the lower end of housing 5, respectively. The lower end opening of housing 5 is closed by end cap 3. T-shaped tongues corresponding to the T-shaped spiral grooves are provided at the inner surface of end cap 3 and the T-shaped tongues are rotated into the T-shaped spiral grooves. This way of connecting end cap 3 to housing 5 has at least two advantages, namely: (1) a simple structure, and (2) convenience of use so that the end cap 3 can be opened or closed just by a slight turn.

A conductive ring 2 is provided on the inside of the lower end of housing 5. Conductive ring 2 is connected to the cathode of the electric source 4. Conductive ring 2 has the advantage that a contact point inside end cap 3 can be fully connected to electric source 4.

A clamping piece 13 is provided on the side face of housing 5. In a preferred embodiment, the clamping piece 13 connects to the housing 5 by two leg members 13*a* and 13*b*.

The soft button capping 12 is made of a silicone material, although it may also be made of other materials having similar properties.

Light bulbs 8 are preferably white light LED lights, although other colored LED lights may be used.

The portion of housing 5 below channel 7 is flat. The side of housing 5 adjacent channel 7 is preferably semicircular.

Light bulbs 8 on fixing plate 9, electric source 4 and elastic switch 11 form a complete circuit via an anode lead wire 10 and a cathode conductive piece 6, in which the number of light bulbs 8 can be determined according to circumstances, and there is a parallel connection among several light bulbs 8.

Fixing plate 9 is inside housing 5. Fixing plate 9 is preferably a PCB conductive plate.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A portable light comprising:

a pen-shaped housing having an upper end, a lower end and a cavity for receiving a power source therein;

said housing further comprising at said upper end a channel having a first channel wall and a second channel wall, said first channel wall and said second channel wall being spaced apart substantially equidistant from each other and parallel to each other, and a plurality of LED lights in said channel arranged in a column; and wherein said channel walls have a height greater than the height of said LED lights.

2. The portable light of claim 1 wherein said housing includes a clamping means.

3. The portable light of claim 2 wherein said clamping means is attached to said housing by a plurality of leg members.

4. The portable light of claim 1 wherein said housing includes a removable end cap at the lower end of said housing.

5. The portable light of claim 4 wherein said end cap and said lower end of said housing include cooperating thread means constructed and arranged to allow removal and attachment of said end cap to said housing.

6. The portable light of claim 5 wherein said thread means comprises corresponding T-shaped spiral grooves and T-shaped spiral tongues.

7. The portable light of claim 1 wherein said housing has a substantially flat front face and substantially semi-circular side walls.

8. The portable light of claim 1 wherein said housing further includes a switch cavity at said upper end of said housing and an elastic switch member disposed therein for turning said portable light on and off.

9. The portable light of claim 1 wherein said power source comprises one or more batteries.

10. A portable light comprising:

a pen-shaped housing having an upper end, a lower end, a cavity for receiving a power source therein and a removable end cap at the lower end of said housing;

said housing further comprising a substantially flat front face and a substantially semi-circular side wall, an upper end of said substantially flat front face further includes a channel having a first channel wall and a second channel wall, said first channel wall and said second channel wall being spaced apart substantially equidistant from each other and parallel to each other, and a plurality of LED lights in a column in said channel;

said housing further having a switch cavity at said upper end of said housing and an elastic switch member disposed therein for turning said portable light on and off.

11. The portable light of claim 10 wherein said housing includes a clamping means.

12. The portable light of claim 11 wherein said clamping means is attached to said housing by a plurality of leg members.

13. The portable light of claim 10 wherein said end cap and said lower end of said housing include cooperating thread means constructed and arranged to allow removal and attachment of said end cap to said housing.

14. The portable light of claim 13 wherein said thread means comprises corresponding T-shaped spiral grooves and T-shaped spiral tongues.

15. The portable light of claim 10 wherein said plurality of LED lights comprises at least four LED lights.

16. The portable light of claim 10 wherein said power source comprises one or more batteries.

17. A portable light comprising:

a pen-shaped housing having an upper end, a lower end, a cavity for receiving a power source therein and a removable end cap at the lower end of said housing;

said housing further comprising a substantially flat front face and a substantially semi-circular side wall, an upper end of said substantially flat front face further includes a channel having a first channel wall and a second channel wall, said first channel wall and said second channel wall being spaced apart substantially equidistant from each other and parallel to each other, and a plurality of LED lights in a column in said channel and comprising at least four LED lights;

said housing further having a switch cavity at said upper end of said housing and an electric switch member disposed therein for turning said portable light on and off; and said housing includes a clamping means at said upper end.

18. The portable light of claim 17 wherein said clamping means is attached to said housing by a plurality of leg members.

19. The portable light of claim 17 wherein said means for removal of said end cap comprise thread means.

20. The portable light of claim 19 wherein said power source comprises a plurality of batteries.

* * * * *